US008668748B2

(12) United States Patent
Vanlaer et al.

(10) Patent No.: US 8,668,748 B2
(45) Date of Patent: Mar. 11, 2014

(54) COMPOSITION, FUEL AND PROCESS FOR THE REEMULSIFICATION OF A FUEL BASED ON VEGETABLE AND/OR MINERAL OIL

(75) Inventors: Antoine Vanlaer, Paris (FR); Alain Desaga, Casablanca (MA)

(73) Assignee: Mexel Industries, Paris (FR)

( * ) Notice: Subject to any disclaimer, the term of this patent is extended or adjusted under 35 U.S.C. 154(b) by 651 days.

(21) Appl. No.: 12/892,200

(22) Filed: Sep. 28, 2010

(65) Prior Publication Data

US 2011/0078945 A1 Apr. 7, 2011

(30) Foreign Application Priority Data

Oct. 1, 2009 (FR) ..... 09 56838

(51) Int. Cl.
*C10L 1/32* (2006.01)

(52) U.S. Cl.
USPC ..... 44/301

(58) Field of Classification Search
USPC ..... 44/301, 331
See application file for complete search history.

(56) References Cited

U.S. PATENT DOCUMENTS

| | | | | |
|---|---|---|---|---|
| 4,459,132 | A | 7/1984 | Kaufman et al. | |
| 4,810,261 | A * | 3/1989 | Sung et al. | 44/331 |
| 2006/0162237 | A1 * | 7/2006 | Mullay et al. | 44/301 |
| 2009/0257960 | A1 | 10/2009 | Kim et al. | |

FOREIGN PATENT DOCUMENTS

| | | | |
|---|---|---|---|
| EP | 0303862 | A1 | 2/1989 |
| WO | 2007128776 | A1 | 11/2007 |

OTHER PUBLICATIONS

International Search Report, dated Jun. 21, 2010, from corresponding French application.

* cited by examiner

*Primary Examiner* — Walter D Griffin
*Assistant Examiner* — Chantel Graham
(74) *Attorney, Agent, or Firm* — Young & Thompson

(57) ABSTRACT

An emulsifying composition intended to homogenize and reemulsify a fuel, includes by weight, with respect to the total weight of the composition, a) from 5% to 40% of N-oleyl-1, 3-propylenediamine, b) from 50% to 95% of N,N',N'-polyoxyethylene-N-tallowpropylenediamine and c) from 5% to 40% of a solvent. A fuel including the abovementioned composition, a process for the manufacture of the composition and its use are also described.

14 Claims, 2 Drawing Sheets

COMPOSITION, FUEL AND PROCESS FOR THE REEMULSIFICATION OF A FUEL BASED ON VEGETABLE AND/OR MINERAL OIL

The present invention relates to a (re)emulsifying composition capable of homogenizing and reemulsifying a mixture based on mineral oils and/or on vegetable oils and on water.

The present invention also relates to the process of preparation and to the use of this (re)emulsifying composition.

The present invention also relates to a homogenous fuel which is stable over time (at least one year) and to its process of manufacture.

STATE OF THE ART

Fuels are used in numerous fields, such as those of aircraft, motor vehicles or ships, or heating.

A fuel is a mixture of several hundred hydrocarbons resulting from the refining of crude oil of fossil origin. Fuels are in effect generally mixtures of hydrocarbons: for petrol, it is possible to reckon on approximately 20 to 30% of alkanes of $C_nH_{2n+2}$, 5% of cycloalkanes, 30 to 45% of alkenes and 30 to 45% of aromatics.

The European Directive of 1998 on the quality of fuels introduced European specifications for petrol, diesel and gas oils. This Directive was reinforced by that of 2003, targeted at promoting the use of biofuels or other renewable fuels for transportation purposes.

A biofuel or agrofuel is a fuel produced from nonfossil organic materials originating from biomass. Two main pathways exist: the oil pathway (resulting from the oil palm, sunflower, rape, the jatropha plant or the castor oil plant) and derivatives (biodiesel) and the alcohol pathway (bioethanol obtained by fermentation of sugars by yeasts), starting from hydrolysed starch, hydrolysed cellulose or hydrolysed lignin.

Given the growing preoccupation with ecological matters, these fuels look set to undergo expansion. Furthermore, it is also allowed to mix fuels of vegetable origin (current standard approximately 10%, soon 30%) with fuels of mineral origin. Furthermore, the residual amount of water in the fuels currently must not exceed 200 ppm.

In point of fact, fuels based on vegetable and/or mineral oils exhibit problems of miscibility over time.

This is because the presence of a significant water content can cause a separation of the alcohol from the diesel fuel or of the alcohol from the petrol fuel. The presence of water in a fuel can be due in particular to: (i) the absorption of the water from the air, (ii) the intrinsic water content present, and (iii) the diesel/petrol fuels taking the water from the refinery pipes, which are normally rinsed with water.

Thus, during storage in a vessel, the various constituents of the fuel will gradually separate to form layers (phase separating) which will be formed under the action of the various densities of the various constituents. In the vessel, there will thus be, under the space left during the filling of the vessel, which is filled with air more or less laden with water vapour, a first phase composed of the fuel (petrol, gas oil, and the like) comprising suspended water microdroplets. Under this mass of fuel, there will be found a second phase composed of vegetable oils with more or less suspended matter and bacteria and, further below, there will be found a third phase composed of water with bacteria. In point of fact, this phase separation has the consequence of detrimentally affecting the efficiency of the fuel.

As regards ethanol biofuels, it has been found that the ethanol attracts and combines with the moisture of the air, with which it produces an ethanol/water blend. The water in the fuel causes knocking of the engine and the accumulation of soot capable of damaging some components of the engine. The fuel naturally comprises 0.5% of suspended water. When the percentage of water exceeds this threshold, the water droplets agglomerate and separate from the fuel. The water/ethanol blend are heavier than the water molecules and thus accumulate in the bottom of the tank. This is the separation of phases. The ethanol provides a significant share of the octane number of the fuel which serves to provide energy; consequently, when the ethanol separates and falls to the bottom of the tank, the remaining fuel no longer has a sufficient octane number to correctly feed the engine. Furthermore, the ethanol/water mixture is only partially combustible, which can cause severe problems in the engine. Even if substantially dehydrated ethanol is prepared, it will, given that it is very hygroscopic, rapidly absorb the moisture from the atmosphere, unless it is subjected to special storage techniques.

In the state of the art, the product Aquazole®, manufactured by ELF, has been provided, which product is 85% composed of gas oil, 13% composed of water and from 2 to 3% composed of petroleum and chemical additives necessary for the "dilution" of the water in the gas oil. However, this product has been withdrawn from sale due to its instability. Specifically, the emulsion had a lifetime of approximately three weeks.

Moreover, it is known from the state of the art to also add additives, such as organometallics (toxic), which increase the octane number (petrol engine) or additives which increase the cetane number (diesel engine), in order to improve the explosive strength of the fuel. However, these additives do not make it possible to emulsify a fuel which may or may not have already separated into phases.

Consequently, in addition to being stable at low temperatures, stable to sudden variations in temperature, stable to oxidation and resistant to bacterial contamination, the mineral and/or vegetable oil fuel must also be stable on storage.

SUMMARY OF THE INVENTION

The aim of the present invention is to provide a novel emulsifying composition which avoids all or part of the above-mentioned disadvantages.

A subject-matter of the present invention is a (re)emulsifying composition intended to homogenize and reemulsify a fuel, comprising by weight, with respect to the total weight of the said composition:

a) from 5% to 40% of N-oleyl-1,3-propylenediamine, b) from 50% to 95% of N,N',N'-polyoxyethylene-N-tallowpropylenediamine, c) from 5% to 40% of a solvent.

In a field where research has been prolific for many years and where, despite expensive and substantial processing means, no convincing solution has been found, the present Applicant Company has developed a novel composition which exhibits certain advantages.

This is because the present composition is capable of reemulsifying fuels based on mineral oils (hydrocarbons) and/or on vegetable oils and on water, even if the fuel has already separated into phases, in order to form a reemulsion which is stable over time. The composition according to the present invention thus exhibits the advantage of reemulsifying the third phase mentioned above, that is to say the aqueous phase with bacteria, and of remixing it and of homogenizing it with the other phases.

Furthermore, the reemulsion of the fuel by virtue of the composition according to the present invention is stable over time.

In addition, this reemulsion will make it possible to create a cascade of positive effects from storage as far as the waste products from the fuel, that is to say: better homogenization of the various components (mineral oil, water, vegetable oil, and the like), peptization and rheology (the viscosity of the fuel will in effect be constant), which will themselves result in an improvement in the combustion (homogeneous combustion), optimized outputs of the diesel engine, petrol engine, and the like (reduction in the consumption of fuel, cleanliness of the surfaces, progressive cleaning of the engine) and a reduction in pollution (reduction in carbon dioxide discharge, decrease in fouling).

These effects will be illustrated in the examples below.

Preferably, the composition comprises by weight, with respect to the total weight of the emulsion:

a) from 12% to 16% of N-oleyl-1,3-propylenediamine, b) from 60% to 78% of N,N',N'-polyoxyethylene-N-tallowpropylenediamine, c) from 12% to 18% of a solvent.

N,N',N'-polyoxyethylene-N-tallowpropylenediamine is preferably a tallowdiamine comprising 7 mol of ethylene oxide. This compound comprising 7 mol of ethylene oxide is liquid in ambient air (25° C.) and comprises approximately 3% of $C_{14}$, 30% of $C_{16}$, 40% of $C_{15}$, 26% of $C_{18}$ and 1% of $C_{20}$. It is known as a wetting, dispersing and emulsifying agent. The product Dinoramox® S7 from Ceca Arkema Group is suitable in particular for the present composition.

The compound N-oleyl-1,3-propylenediamine corresponds to CAS No. 7173-62-8. In particular, the product sold under the trade name Dinoram® O from Ceca is suitable for the present invention.

Advantageously, the solvent is chosen from isopropylbenzene and kerosene.

Another subject-matter of the present invention is a fuel comprising at least one mineral oil, one vegetable oil and water, additionally comprising the emulsifying composition according to one of the characteristics described above.

Preferably, the mineral oil is present at a level of 0% to 97% by weight, the vegetable oil at a level of 0% to 97% by weight and the water at a level of 0.001% to 8% by weight, with respect to the total weight of the said fuel.

Advantageously, the emulsifying composition is present, by weight, at a level of 3% to 48%, with respect to the total weight of the said fuel.

One aim of the present invention relates to a process for the preparation of an emulsifying composition as described above, characterized in that it comprises the stages consisting in:

i) heating the N-oleyl-1,3-propylenediamine and the N,N',N'-polyoxyethylene-N-tallowpropylenediamine, so as to obtain a first liquid mixture, ii) adding the solvent to this first mixture with stirring, so as to obtain a liquid emulsifying composition.

According to one characteristic of the invention, the heating stage i) is carried out at a temperature between 30° C. and 50° C., preferably between 35° C. and 45° C. and more preferably still at 40° C.

Preferably, the stirring is carried out at between 20 rev/min and 50 rev/min during the heating i).

According to one characteristic of the invention, the heating and the stirring are carried out for at least 5 days.

Advantageously, the solvent is isopropylbenzene, so that the emulsifying composition resulting from stage ii) is still liquid at temperatures lying between 0° C. and 20° C.

Another aim of the present invention also relates to a process for the manufacture of a fuel according to one of the abovementioned characteristics, comprising the stage consisting in adding from 3% to 48% by weight of an emulsifying composition as described above to a base fuel comprising, with respect to the weight of the said base fuel, from 0% to 99% by weight of a vegetable oil, from 0% to 99% by weight of a mineral oil and from 0.01% to 8% by weight of water.

Preferably, the emulsifying composition is obtained by the abovementioned preparation process.

The present invention also relates to the use of the emulsifying composition as described above in homogenizing and reemulsifying a fuel based on mineral oil, on vegetable oil and on water.

DETAILED DESCRIPTION OF THE INVENTION

In order to bring about a better understanding of the subject-matter of the invention, a device capable of making it possible to obtain the emulsions according to the invention will be described below. The descriptions which will follow are given as purely illustrative and nonlimiting examples; the drawing of the emulsifying device is a diagrammatic drawing intended solely to illustrate the principle of the device employed in the implementation of the examples of the emulsions according to the invention.

Figure 2:
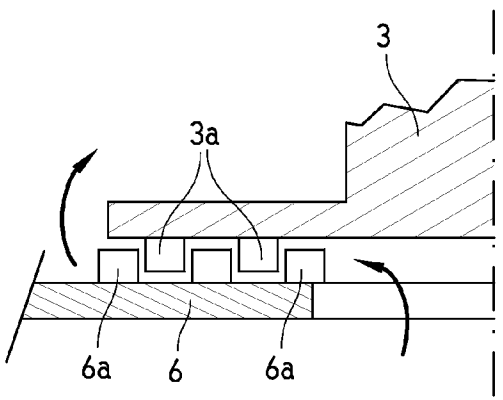
FIG. 2 is a partial and diagrammatic representation of the vanes of the rotor and of the stator, the interaction of which vanes makes it possible to obtain a high degree of shearing and consequently an emulsion with is sufficiently fine to come within the scope of the present invention.
Figure 1:
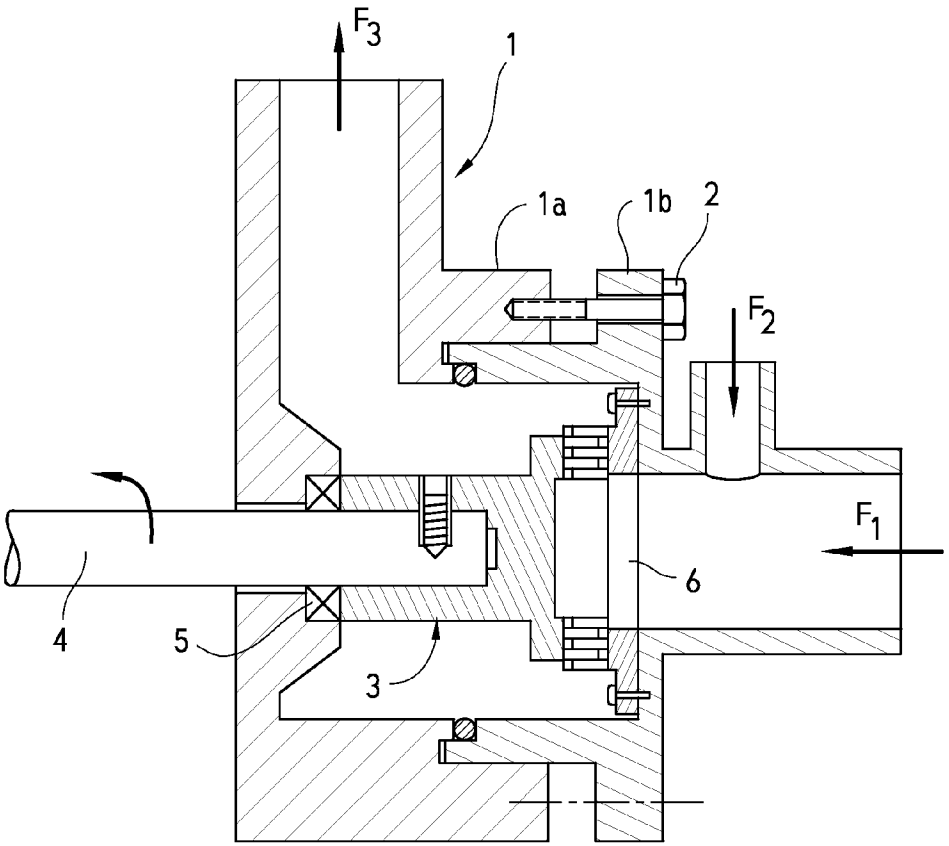
FIG. 1 represents, in axial section, an emulsifying device which makes it possible to obtain the compositions according to the invention.

Although the emulsifying device represented in FIGS. 1 and 2 does not form part of the invention, a quick description of it will be given below. The designation 1 has been given to the stator of the emulsifier in its entirety. The stator 1 is composed essentially of two parts 1*a* and 1*b* assembled together by means of bolts 2. The stator 1 receives a rotor, denoted by 3 in its entirety, the rotor 3 being driven in rotation with respect to the stator via a shaft 4. The rotation of the rotor 3 and of the shaft 4 with respect to the stator 1 is made possible by virtue of a system of leaktight bearings 5.

The part 1*b* of the stator comprises the inlet pipes for the products intended to form the emulsion: for example, the component a) is conveyed along the arrow F1 and the component b) of the emulsion is conveyed along the arrow F2 (or vice versa). The combined mixture enters the stator, which comprises a circular blade holder 6 attached via screws to the part 1*b* of the stator, the blades 6*a* of the blade holder 6 being radial and directed towards the rotor 3, that is to say on the side opposite the arrival of the products to be emulsified. The end of the rotor 3 which is opposite the blade holder 6 has the form of a plate which carries radial blades 3*a*. The blades 3*a* and 6*a* are positioned along concentric circles, the blades 3*a* being situated in the circular annular spaces which exist between two successive circles of blades 6*a*.

The products to be emulsified enter the region between the blade holder 6 and the rotor 3 via a central circular orifice of the blade holder 6, centrifugally traverse the space between the blade holder 6 and the rotor 3 and are ejected at the periphery of the said space in order to be able to be discharged out of the device along the arrow F3. It is clear that the stream of incoming products is subjected to successive shearings between the stationary blades 6*a* and the blades 3*a* driven in rotation by the shaft 4. In a known way, the fineness of the emulsion obtained depends in particular on the number of concentric circles of blades 3*a* and 6*a*, on the radial space between the edges of the said blades and on the rotation speed of the shaft 4. In other words, for a given device and a given throughput, the characteristics of the emulsion obtained depend on the rotational speed of the rotor.

Preferably, a rotational speed of the order of 6500 revolutions/minute is suitable for obtaining fluid emulsions according to the present invention.

The process as defined above makes it possible to continuously obtain homogenous and uniform emulsions; however, it is also possible to produce the emulsions according to the invention batchwise (batchwise process).

As indicated above, a subject-matter of the present invention is in particular a reemulsifying composition which makes it possible to homogenize and to reemulsify all the various components of a base fuel composed of vegetable oil, of mineral oil and of water. The vegetable oil or the mineral oil can each correspond to 99% of the total amount of the base fuel, while water can correspond to approximately from 0.1 to 8% of the base fuel.

The reemulsifying composition comprises in particular the use of two specific diamines: a) N-oleyl-1,3-propylenediamine (such as the product Diniram® O) and b) N,N',N'-polyoxyethylene-N-tallowpropylenediamine (in particular a tallowdiamine comprising 7 mol of ethylene oxide, such as the product Dioramox® S7), and in addition in concentrations which are also highly specific, of the order of 5 to 40% for the first diamine and of the order of 50 to 95% for the second diamine (weight/weight of the overall composition).

This is because the present applicant has found that these two selections, that is to say the selection of the amines to be used from all the existing amines having an emulsifying action, on the one hand, and the selection of the highly specific concentrations, on the other hand, make it possible to obtain a composition which makes possible the reemulsification of a fuel, whether based on mineral oil and/or on vegetable oil and on water.

These two diamines are dissolved by virtue of a third compound: a solvent, such as isopropylbenzene (CAS No. 98-82-8) or kerosene.

Other compounds can be added, such as fungicides, bactericides and other additives generally used in fuels.

The various advantages of the present composition may be due to the chemical structures of the various compounds of the reemulsifying composition.

This is because the complex compounds comprising amino functional groups, composed of long chains of high molecular weight which may be partially ethoxylated, make it possible to considerably lower the interfacial tensions between the more or less soluble components and the hydrocarbons of a fuel, thus ensuring a dispersion of the "peptization" type (at the molecular scale) of the insoluble components and thus conferring a very high homogeneity on the fuel.

This peptizing action makes it possible to gradually "clean" the tanks of the vehicles treated with the composition according to the invention. Furthermore, the polar compounds of the composition protect the tanks (also engine, and the like) from corrosion phenomena.

The lowering of the surface tensions also has as consequence a lowering of the viscosity of the fuels and also makes it possible to reduce the angle of fuel/metal interfacial tensions, thus improving the rheology of the fuel by converting the turbulent flow into laminar flow.

This two-fold action will have as consequence the formation of a more uniform and very finely divided mist, within which the surface areas for contact with the oxidant air have expanded to a maximum.

The combustion of these mixtures of oils thus reemulsified thus provides a more complete combustion and greatly limits the production of noncombustibles; the ash then comprises a low level of carbon.

Furthermore, as is demonstrated in the tests below, the strongly antioxidant properties of the reemulsifying composition according to the invention make it possible to combat corrosion by the oxidizable compounds of the fuels. This is because the amino compounds oppose the dissociation of the oxides which release atomic oxygen and also that of the molecular oxygen. The atomic oxygen "O" is capable of oxidizing sulphur trioxide $SO_3$ to give sulphate $SO_4$. The reemulsifying composition has the effect of interfering with the ability of the metal oxides to be dissolved by alkali metal vanadates and of having a "poisoning" power with regard to catalysts which are formed from sodium and vanadium oxides in particular.

In addition, the nitrogenous derivatives act as "limiter" of acid attack.

Examples of emulsion according to the invention which are purely illustrative and without implying limitation of the scope of the invention will now be described. These tests were carried out in order to demonstrate the stability over time of the fuel according to the present invention and also its effectiveness.

EXAMPLE 1

Monitoring of the Quality of an Engine Oil

Composition of the (Re)Emulsifying Composition According to the Invention

For this test, and for the following tests (Tests 2 to 4), the reemulsifying composition according to the invention comprises, with respect to the total weight of the composition:

a) 14.76% of N-oleyl-1,3-propylenediamine (Dinoram® O),
b) 69.53% of N,N',N'-polyoxyethylene-N-tallowpropylenediamine (Dinoramox® S7),
c) 15.71% of isopropylbenzene.

This test was carried out on a diesel engine of a Volvo type F10 lorry exhibiting the following characteristics:

| | |
|---|---|
| km before treatment: | 603 025 km |
| km at end of treatment: | 612 042 km |
| Δ km covered: | 9017 km |
| Lubricant: | SAE40 oil |

Protocol

In order to confirm the quality of the engine oil, use was made of a sheet of filter paper in a horizontal position exhibiting a mesh size of 0.1 μm.

The procedure consists in allowing a diesel engine, operating by virtue of a gas oil fuel not comprising the composition according to the invention, to run for a period of 10 minutes in ambient air at 25° C. The oil was then at its normal operating temperature. Via the dipstick, a drop of oil was deposited at the centre of the filter paper. This filter paper was kept in a horizontal position without contact with a solid surface with the exclusion of dust for 24 hours. The various regions brought out during the spreading of the drop of oil were then read. A first "control" paper is thus obtained.

The same procedure was carried out but this time the fuel of the lorry comprised the (re)emulsifying composition according to the invention at a concentration of 30 ppm. A second filter paper was thus obtained.

Method of Interpretation of the Results

A stain of detergent oil is composed, from the inside towards the outside, of four elements which are more or less distinct from one stain to another, which are as follows:

1) a grey central part, more or less opaque, the opaqueness of which makes it possible to characterize the state of fouling of the oil;

2) a darker halo which surrounds the central part and which corresponds to the maximum spreading of the drop of oil over the surface of the paper;

3) a less dark diffusion region, which characterizes the dispersive power of the detergent oil; only the oils containing, in suspension, sooty particles having a size of less than 0.5 micron will give a diffusion region;

4) a translucent region, impregnated with oil freed from the sooty materials. The more or less yellowish colour can give ideas of the state of oxidation of the oil and of the presence of fuel.

In order for an oil to be correct and to be able to still remain in surface, it is necessary for these four elements of a stain to be able to be distinguished. It is also necessary to take into account that, for an engine in good condition, the stains produced during the first hours give rise only to a greyish halo, the four elements only beginning to be discernible after a certain service time which can moreover vary according to the types of engines.

From this examination, four elements can be drawn: the detergency, the pollution, the oxidation and the dilution.

The detergency: The diffusion region 3) gives, by its width, an idea of the detergency; the appearance of this region indicates that the oil has lost all dispersive power. This can be due either to the saturation of the detergent by an excess of carboids or to the flocculation of the dope (element constituting the detergency) in the presence of water.

The pollution: The region 1) of the stain increases in opaqueness as the percentage of carboids increases: towards 5% of deposits, the central part 1) becomes black and the halo 2) disappears; if the oil is still detergent, the diffusion region 3) still remains apparent; if, and this often happens in the case of high pollution, the detergent dope is saturated, the stain exhibits only an entirely black central part encircled by the translucent region 4).

The oxidation: The part of the translucent region 4) bordering the diffusion region 3) gives, by its more or less dark yellow, an indication with regard to the oxidation of the oil: a light yellow colour indicates that the oil is not significantly detrimentally affected and a dark yellow colour indicates that the oil is oxidized.

The dilution: When the oil is diluted by the fuel, the translucent region 4) is terminated on the inside by a light edging, the width of which increases with the extent of the dilution.

The observations relating to the oxidation and in particular to the dilution are difficult to formulate; the two phenomena are not reflected on the paper by differences in colour which are sufficiently marked but information can be drawn therefrom, for example on an engine which is regularly monitored.

Results

The test was repeated after 9017 km had been covered, the engine being fed with gas oil treated with the (re)emulsifying composition according to the invention.

The filter paper was positioned vertically in front of a light in order to allow the various regions to be seen well. By simultaneously comparing the two filter papers obtained as explained above, that before treatment and that after treatment according to the present invention, it is clearly apparent that the filter paper obtained after treatment presents:

- a central region which is much lighter, indicating a reduced amount of carbonaceous particles;
- a region external to the central part which is markedly lighter; the particles are well distributed, indicating a good level of dispersion;
- and a region at the external limits, which id dispersed in the preceding region and at the edging of the stain, so that he dilution disappears.

Conclusion

This test thus clearly shows the importance of the detergency effect of the composition according to the invention: the combustion chamber of each cylinder having been cleaned, the segmentation has again played its part with regard to leaktightness and has made it possible to regain the qualities of the engine oil.

EXAMPLE 2

Corrosion Test 2.1 With Regard to Copper

A concentration of 100 ppm of the (re)emulsifying composition according to the invention was added to gas oil. Two tests were carried out: a first control test (control strip) corresponding to a strip not treated with the composition and a second test corresponding to a strip treated with the reemulsifying composition according to the invention.

Conditions of the Test

| | |
|---|---|
| Adaptation of the standard | NF [French Standard] M07-015 |
| Test specimen | Strip with dimensions of 100 × 25 × 3 mm made of 99.9% pure electrolytic copper, rolled, polished (400 paper, steel wool) and degreased 3 times with acetone, dehydrated over activated molecular sieve. |
| Fuel | Gas oil |
| Duration of the test | 3 hours |
| Temperature of the bath | 50° C. ± 1° C. |
| Stirring | Magnetic with a magnetic bar (50 rev/min) |

The two strips were immersed in gas oil respectively untreated and treated with the reemulsifying composition according to the invention in a bath at a temperature of approximately 50° C., with magnetic stirring and for three hours.

Conclusion

In the presence of distilled water, no corrosion appeared on the copper strip treated with the composition according to the invention, in contrast to the control strip and to the untreated strip.

2.2 With Regard to Steel

A concentration of 100 ppm of the (re)emulsifying composition according to the invention was added to gas oil. Two tests were carried out: a first control test (control strip) corresponding to a strip not treated with the composition and a second test corresponding to a strip treated with the reemulsifying composition according to the invention.

Conditions of the Test

| | |
|---|---|
| Adaptation of the standard | ASTM D665-92-"Determination of rust preventing, characteristics of steam turbine oil, in the presence of water" |
| Test specimen | Strip with dimensions of 100 × 25 × 3 mm made of rolled steel which is polished (400 paper, steel wool), degreased 3 times with acetone and dehydrated over activated molecular sieve |
| Fuel | Gas oil |
| Duration of the test | 24 hours |
| Temperature of the bath | 60° C. ± 1° C. |
| Stirring | Magnetic with a magnetic bar (50 rev/min) |

The two strips were immersed in gas oil respectively untreated and treated with the reemulsifying composition according to the invention in a bath at a temperature of approximately 60° C., with magnetic stirring and for 24 hours.

On the untreated strip, corrosive stains appear, whereas, on the strip treated with the composition of the present invention, no corrosive stain is observed.

Conclusion

This test brings to the fore the corrosion-inhibiting nature of the reemulsifying composition according to the invention with regard to steel.

EXAMPLE 3

Test of Destructuring of the Deposits

This test was carried out on finned tubes of an economizer of a stack of a 300 MW boiler. 100 ppm of the reemulsifying composition according to the invention were added to the fuel of the boiler. This fuel comprises the following characteristics:

| | |
|---|---|
| Viscosity at 40° C. | 3032 cSt |
| Density at 15° C. | 0.847 g/cm$^3$ |
| Gel point | −21° C. |
| Ignition point | 68° C. |
| NCV | 9800 kcal/kg |
| Sulphur | 0.13% |
| Sodium | 0.4771 mg/kg |
| Potassium | 0.1525 mg/kg |
| Vanadium | <0.1 mg/kg |
| Water | 315 ppm |
| Cetane number | 47 |

Figure 3:
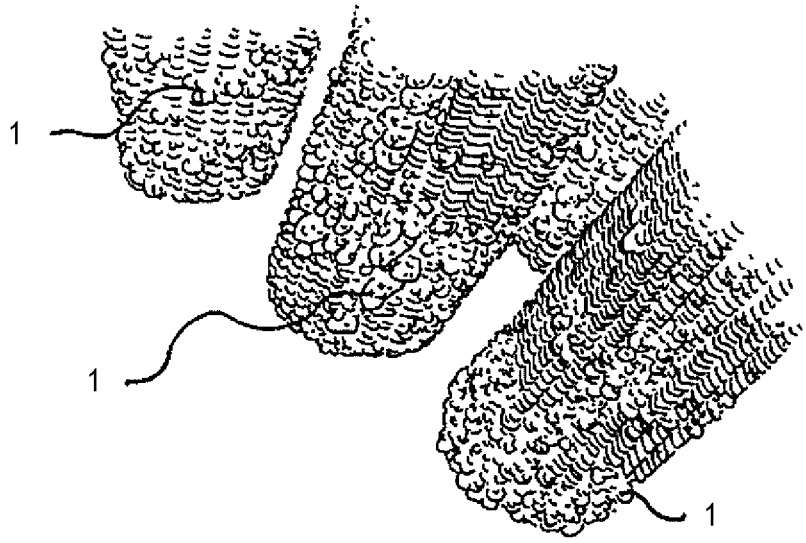
FIG. 3 is a photograph showing fins of a boiler before the use of a fuel enriched with the reemulsifying composition according to the present invention.

Before the addition of the reemulsifying composition according to the invention, the fins of the tubes of the boiler disappeared under a deposit and the corrosion 1 (FIG. 3) by sulphuric acid was visible at the junctions.

Figure 4:
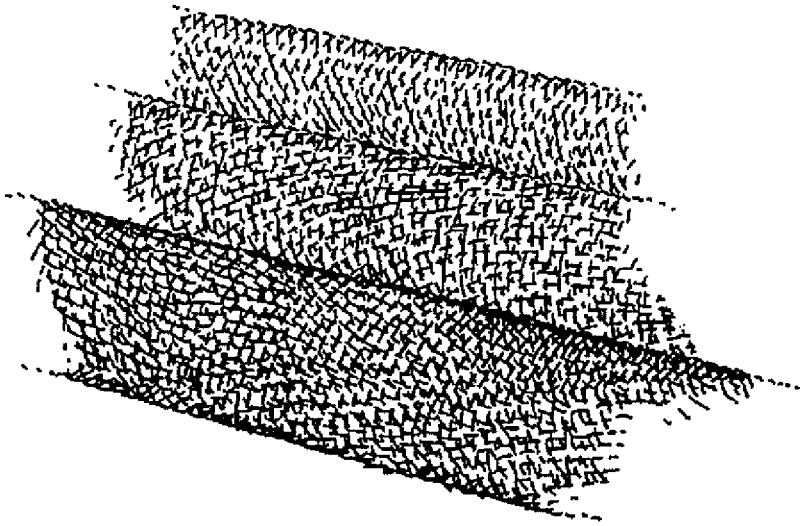
FIG. 4 represents the same fins as in FIG. 3 but two and a half months after having been treated with the reemulsifying composition according to the invention.

After the addition of 100 ppm of the reemulsifying composition according to the invention and for a treatment of 2.5 months, the finned tubes have been naturally cleaned (without mechanical or other intervention) (see FIG. 4).

Conclusion

The reemulsifying composition has allowed progressive destructuring of the deposit existing on the finned tubes and their maintenance in a noteworthy state of cleanliness without apparent corrosion.

EXAMPLE 4

Test of Monitoring and Reestablishment of Compression Pressures

Measurements of the pressure of the compression of each cylinder of the diesel engine were carried out on an IR 00 795 engine of 250 HP of a Pegaso lorry operating with gas oil. The lorry exhibited 115 533 km before the test (that is to say, before operating with a gas oil enriched with 100 ppm of the reemulsifying composition according to the invention) and 116 135 km after the test, i.e. a difference of 602 km.

The use of a device of Henry type, fitted to each cylinder, on dummy injectors, made it possible to obtain the compression pressures of each cylinder.

The operation was thus carried out without and with the reemulsifying composition according to the invention at a concentration of 100 ppm.

The results obtained were as follows:

| | Compression pressures | |
|---|---|---|
| Cylinder number | during the test with gas oil alone | during the test with gas oil enriched with the reemulsifying composition according to the invention at 100 ppm |
| 1 | 26 | 26 |
| 2 | 25 | 25.7 |
| 3 | 24 | 25.5 |
| 4 | 24 | 25.5 |
| 5 | 22.7 | 25.4 |
| 6 | 22.2 | 25.5 |

The comparative analysis of the results, cylinder by cylinder and over all of the cylinders, has made it possible to observe a reestablishment of the compression pressures and a general levelling out of the compression pressures when the reemulsifying composition according to the invention was added to the gas oil.

These results clearly demonstrate the detergent and destructuring effect of the reemulsifying composition in the combustion chambers of the engine.

In conclusion, the composition according to the present invention makes it possible first of all to reemulsify fine water droplets present in mixtures of mineral and/or vegetable oils. Furthermore, the composition is an excellent peptizing, stabilizing, wetting, detergent and corrosion-inhibiting agent which acts from storage as far as the pipes for discharge of the flue gases. In addition, it makes it possible to reduce bacterial proliferation by destructuring the organic and/or inorganic deposit or deposits due to the cleaning effect of the reemulsifying product keeping the surfaces clean.

Although the invention has been described in connection with a specific embodiment, it is clearly evident that it is in no way limited thereto and that it comprises all the technical equivalents of the means described and their combinations, if the latter come within the scope of the invention.

The invention claimed is:

1. Emulsifying composition intended to homogenize and reemulsify a fuel, comprising by weight, with respect to the total weight of the said composition:

a) from 5% to 40% of N-oleyl-1,3-propylenediamine, b) from 50% to 95% of N,N',N'-polyoxyethylene-N-tallow-propylenediamine, c) from 5% to 40% of a solvent.

2. Emulsifying composition according to claim 1, comprising by weight, with respect to the total weight of the emulsion:

a) from 12% to 16% of N-oleyl-1,3-propylenediamine, b) from 60% to 78% of N,N',N'-polyoxyethylene-N-tallowpropylene-diamine, c) from 12% to 18% of a solvent.

3. Emulsifying composition according to claim 1, in which the solvent is chosen from isopropylbenzene and kerosene.

4. Fuel comprising at least one mineral oil, one vegetable oil and water, characterized in that it additionally comprises the emulsifying composition according to claim 1.

5. Fuel according to claim 4, in which the mineral oil is present at a level of 0% to 97% by weight, the vegetable oil at a level of 0% to 97% by weight and the water at a level of 0.001% to 8% by weight, with respect to the total weight of the said fuel.

6. Fuel according to claim 4, in which the emulsifying composition is present, by weight, at a level of 3% to 48%, with respect to the total weight of the said fuel.

7. Process for the preparation of an emulsifying composition according to claim 1, characterized in that it comprises the stages consisting in:

i) heating the N-oleyl-1,3-propylenediamine and the N,N',N'-polyoxyethylene-N-tallowpropylenediamine, so as to obtain a first liquid mixture, ii) adding the solvent to this first mixture with stirring, so as to obtain a liquid emulsifying composition.

8. Process for the preparation of an emulsifying composition according to claim 7, in which the heating stage i) is carried out at a temperature between 30° C. and 50° C.

9. Process for the preparation of an emulsifying composition according to claim 7, in which the stirring is carried out at between 20 rev/min and 50 rev/min during the heating i).

10. Process for the preparation of an emulsifying composition according to claim 7, in which the heating and the stirring are carried out for at least 5 days.

11. Process for the preparation of an emulsifying composition according to claim 1, in which the solvent is isopropylbenzene, so that the emulsifying composition resulting from stage ii) is still liquid at temperatures lying between 0° C. and 20° C.

12. Process for the manufacture of a fuel according to claim 4, comprising the stage consisting in adding from 3% to 48% by weight of an emulsifying composition to a base fuel comprising, with respect to the weight of the said base fuel, from 0% to 99% by weight of a vegetable oil, from 0% to 99% by weight of a mineral oil and from 0.01% to 8% by weight of water.

13. Process for the manufacture of a fuel according to claim 12, in which the emulsifying composition is obtained by:

i) heating the N-oleyl-1,3-propylenediamine and the N,N',N'-polyoxyethylene-N-tallowpropylenediamine, so as to obtain a first liquid mixture, and ii) adding the solvent to this first mixture with stirring, so as to obtain the liquid emulsifying composition.

14. Method of homogenizing and reemulsifying a fuel based on mineral oil, on vegetable oil and on water; comprising mixing the emulsifying composition according to claim 1 with said fuel.

* * * * *